United States Patent [19]

Myres

[11] Patent Number: 5,020,726

[45] Date of Patent: Jun. 4, 1991

[54] TWO STAGE FLUID VALVE ASSEMBLY

[76] Inventor: Michael J. Myres, 347½ Concord St., El Segundo, Calif. 90245

[21] Appl. No.: 461,241

[22] Filed: Jan. 5, 1990

[51] Int. Cl.[5] ..... B05B 9/00

[52] U.S. Cl. ..... 239/525; 239/569; 239/586; 239/DIG. 21

[58] Field of Search ..... 239/525, 526, 443, 444, 239/445, 446, 569, 586, DIG. 21, DIG. 22; 137/599; 251/205

[56] References Cited

U.S. PATENT DOCUMENTS

| | | | |
|---|---|---|---|
| 2,229,903 | 1/1941 | Schmohl et al. | 137/599 |
| 2,783,092 | 2/1957 | Gavin et al. | 299/116 |
| 2,917,244 | 12/1959 | Gould | 239/586 |
| 3,129,892 | 4/1964 | Tillman | 239/407 |
| 3,463,120 | 8/1969 | Wallis | 118/626 |
| 3,672,575 | 6/1972 | Hinrichs | 239/445 |
| 3,986,523 | 10/1976 | Pacht | 137/610 |
| 4,124,164 | 11/1978 | Bachman | 239/DIG. 22 |
| 4,413,785 | 11/1983 | Engelbert et al. | 239/443 |

*Primary Examiner*—Andres Kashnikow
*Assistant Examiner*—Karen B. Merritt
*Attorney, Agent, or Firm*—Cahill, Sutton & Thomas

[57] ABSTRACT

A manually operable two stage valve assembly, in fluid communication with a source of fluid under pressure, regulates the discharge of a fluid through a nozzle to one of two predetermined flow rates. Upon independent actuation, the first stage permits a high flow rate and the second stage permits a low flow rate.

22 Claims, 2 Drawing Sheets

TWO STAGE FLUID VALVE ASSEMBLY

BACKGROUND OF THE INVENTION

1. Field of the Invention

The present invention relates to valves and, more particularly, to independently operated two stage valve assemblies for selectively restricting a flow of fluid under pressure.

2. Description of the Prior Art

In most machine shops, a machinist blows clean a work piece or blows shavings away from a piece of metal working machinery with an air gun connected to a source of air under pressure. These air guns have an on/off valve for controlling the flow of air through an attached nozzle; the flow rate of discharged air is primarily a function of the pressure of the air at it's source and the nozzle.

A high flow rate can cause severe problems in propelling the shavings at high speed or far enough to contaminate other equipment or work pieces. The safety of the machinist and other personnel may also be jeopardized by flying shavings, work pieces, etc. Moreover, delicate work pieces might be damaged by an impinging burst of air under high pressure.

For any given source of air under pressure, the maximum flow rate can be altered by substituting a different nozzle on the air gun. Such substitution, while permitting a broad range of discharge flow rates, is cumbersome, time consuming and seldom used in work environments wherein differing air flow rates may be desired interchangeably. To save time, some machinists and other operators have become quite skilled at operating the valve of an air gun to discharge a desired flow rate less than maximum; such skills take a long time to learn. Even so, skilled machinists do not always manage to regulate the conventional air gun sufficiently accurately to have a flow rate of the desired magnitude.

Various air guns, and the like, have been developed for a variety of purposes. U.S. Pat. No. 3,463,120 is directed to an electrostatic gun for discharging powder material, the discharge rate of which is regulated by one of two push buttons for operating respective microswitches. U.S. Pat. No. 3,986,523 is directed to means for sealing the valve assembly of a lever operated high pressure valve. U.S. Pat. Nos. 3,672,575 and 4,413,785 are directed to pressure guns having a secondary valve operated low pressure output. U.S. Pat. Nos. 2,783,092 and 3,129,892 disclose trigger and lever, respectively, operated air guns.

SUMMARY OF THE PRESENT INVENTION

The present invention is directed to a two stage fluid valve assembly, which assembly may be used in conjunction with a source of air under pressure to provide either of two preselected flow rates, depending upon actuation of one or another valve associated therewith. For convenience, each valve is independently lever operated. The maximum flow rate dischargeable is primarily a function of the pressure at the air source and the nature of the nozzle from which the air is discharged. Except for certain friction losses, operation of one of the valves would accommodate the maximum flow rate available. By design, the second valve would serve in the manner of a restrictor or regulator to provide a flow rate below the maximum flow rate and commensurate with the requirements of the work to be performed. While the present invention has been developed primarily for use in conjunction with the discharge of air under pressure, the present invention may be used in conjunction with the discharge of other gases or liquids.

It is therefore a primary object of the present invention to provide a two stage air gun for discharging air at one of two predetermined flow rates.

Another object of the present invention is to provide an air gun having different unambiguous flow rates.

Yet another object of the present invention is to provide a hand holdable two stage valve assembly for discharging air under pressure at different flow rates.

Still another object of the present invention is to provide a multiple lever operated hand holdable valve assembly for providing a predeterminable flow rate of discharged air as a function of the lever actuated.

A further object of the present invention is to provide a hand held thumb operated two stage air gun for discharging air at one of different unambiguous flow rates.

A yet further object of the present invention is to provide a method for regulating air flow discharged from a source of air under pressure.

A still further object of the present invention is to provide an inexpensive readily usable two stage fluid valve assembly.

These and other objects of the present invention will become apparent to those skilled in the art a the description thereof proceeds.

BRIEF DESCRIPTION OF THE DRAWINGS

The present invention may be described with greater clarity and specificity with reference to the following drawings, in which.

DESCRIPTION OF THE PREFERRED EMBODIMENT

Figure 1:
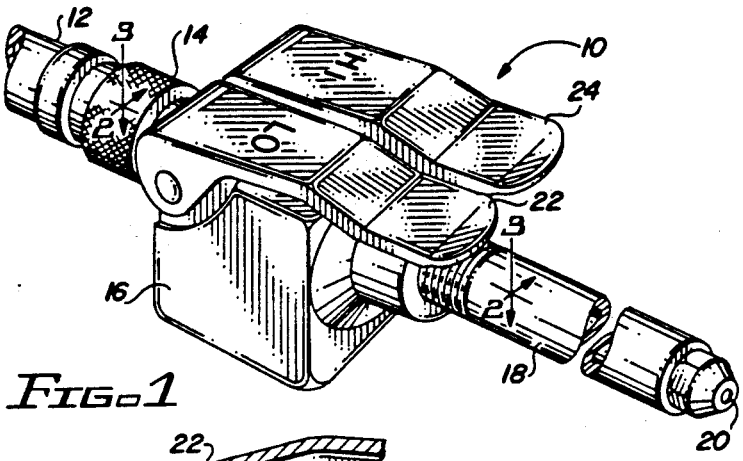
FIG. 1 is an isometric view of the present invention.
Figure 3:
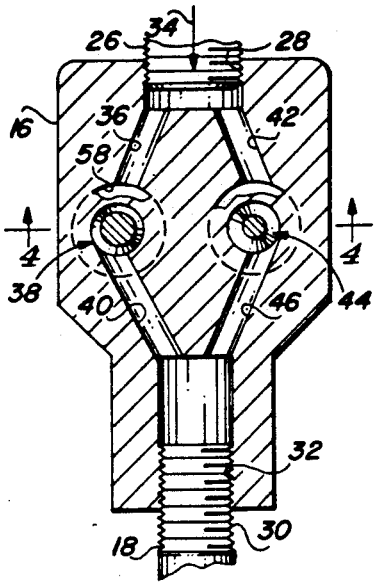
FIG. 3 is a cross sectional view taken along lines 3—3, as shown in FIG. 1.

Referring to FIG. 1, there is illustrated a two stage valve assembly or air gun 10 connected to a source of air under pressure. A hose 12 conveys air from the source of air under pressure to air gun 10 via a conventional coupling 14. The air is conveyed from the coupling through the valves in body 16 and discharged through nozzle 18. To some extent, nozzle 18, in combination with orifice 20, is capable of regulating the maximum air flow rate discharged dependently or independently of the pressure at the source of air pressure. Levers 22, 24 are operatively associated with the valves in body 16 to regulate the flow of air at a low or high, respectively, rate. The valves disposed within body 16 for determining whether a high or low air flow rate is to be discharged from nozzle 18 will be described with joint reference to FIGS. 1 through 4.

A hollow threaded stud 26 interconnects coupling 14 with body 16 by threadedly engaging a threaded passageway 28. Nozzle 18 includes a threaded end 30 in threaded engagement with a threaded passageway 32 in body 16. A flow of air, as depicted by arrow 34, may be channelled through passageway 36 from threaded passageway 28 to valve 38 and via passageway 40 to threaded passageway 32. Similarly, a flow of air may be channeled from threaded passageway 28 through passageway 42 to valve 44 and from there to threaded passageway 32 via passageway 46.

Figure 2:
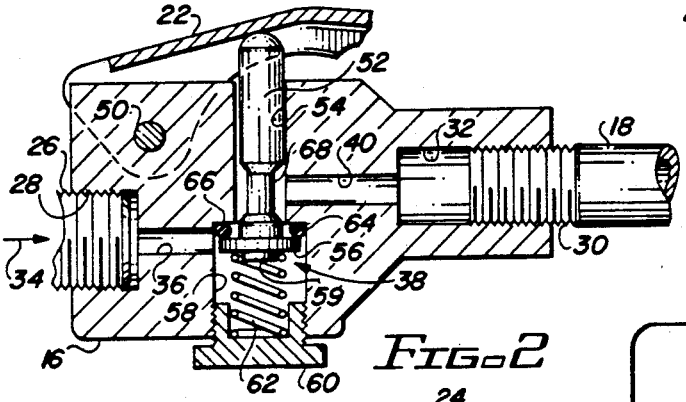
FIG. 2 is a cross sectional view taken along lines 2—2, as shown in FIG. 1.

The operation of valves 38 and 44 will be described with particular reference to FIGS. 2, 4 and 5. Lever 22 is pivotally secured to body 16 through a pin 50, or the like. A piston 52 is translatably mounted within a cylinder 54. As illustrated, the piston extends upwardly form body 16 whereby pivotal movement of lever 22 in the clockwise direction (as shown) will produce a downward force upon the piston with resulting commensurate translatory movement of the piston. The lower end of the piston includes a disc 56 of a diameter larger than that of the piston. The disc is longitudinally translatable within a cylindrical cavity 58 in body 16, which cavity is in fluid communication with passageway 36. A threaded cap 60 is threadedly engageable with cylindrical cavity 58 and provides a seal at the lower end of the cylindrical cavity. Additionally, the cap serves as support for a coil spring 62, which coil spring bears against disc 56 and is positionally maintained by land 59 to bias the piston upwardly. An O-ring 64, or the like, is disposed adjacent shoulder 66 of cylindrical cavity 58 to provide a seal between the shoulder and disc 56. Piston 52 includes an annular necked down section 68. The extent to which this section is necked down is a function of and regulating mechanism for the flow rate of air through valve 38. Passageway 40 is in fluid communication with cylinder 54 via necked down section 68 upon downward translation of piston 52.

In operation, in the quiescent state, air flow intermediate passageway 36 to passageway 40 via valve 38 is precluded by the seal provided by O-ring 64 disposed intermediate disc 56 and shoulder 66. When lever 22 is depressed, piston 52 is forced to translate downwardly. Such downward translation will break the seal provided by O-ring 64 and permit air flow past disc 56. Commensurate with downward movement of the piston, annular necked down section 68 will extend into cylindrical cavity 58 to provide a passage about the annular necked down section to passageway 40. By appropriate dimensioning of the length of the annular necked down section, a state of fluid communication between passageways 36 and 40 will exist. It may be noted that in the fully depressed position of lever 22, the flow rate is not variable and is regulated primarily by the diameter of the annular necked down section.

Figure 4:
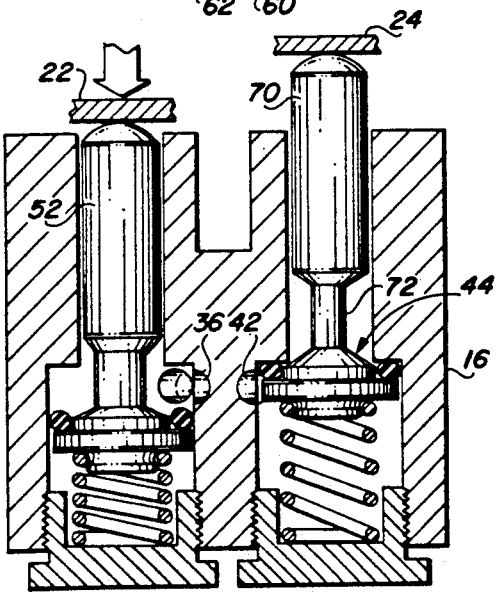
FIG. 4 is a cross sectional view taken along lines 4—4, as shown in FIG. 3.
Figure 5:
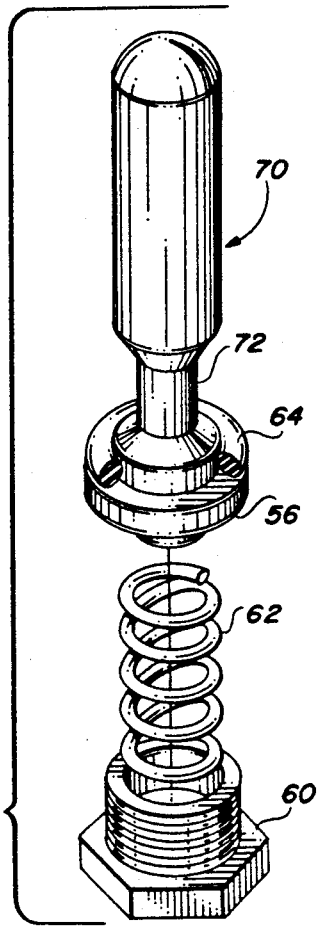
FIG. 5 is an exploded view of a valve assembly.

It will be appreciated that operation of lever 24 will bring about opening of valve 44, as particularly illustrated in FIG. 4. Herein, piston 70 includes an annular necked down section 72 of substantially lesser diameter than that of the annular necked down section of cylinder 52. This reduction in diameter will provide less restriction through valve 44 between passageways 42 and 46 than through valve 38. Accordingly, valve 44 will provide a greater flow rate for a given pressure at the source of air pressure. The remaining components of valve 44 are duplicative of those described above with respect to valve 38.

It therefore becomes evident that an operator, by depressing lever 22 of manually operable two stage air gun 10, will thereby provide an air flow through nozzle 18 at a low flow rate. Conversely, by depressing lever 24, an air flow through nozzle 18 at a higher rate will occur. The air gun thus provides two stages of air flow rate discharge without requiring any more skill than that of depressing one of levers 22, 24.

Figure 6:
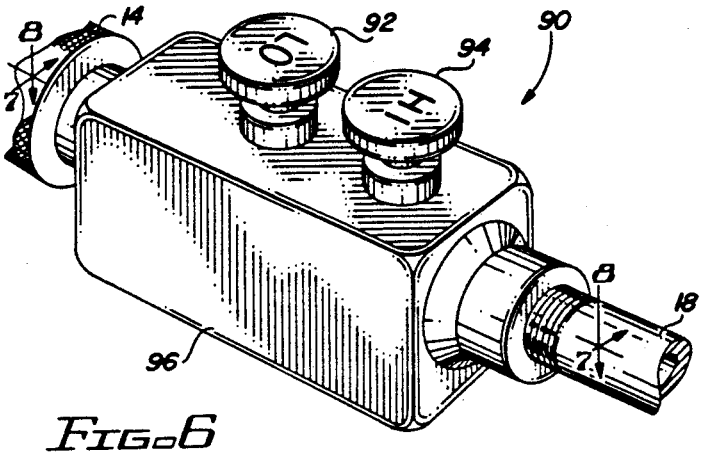
FIG. 6 illustrates a variant of the present invention.
Figure 7:
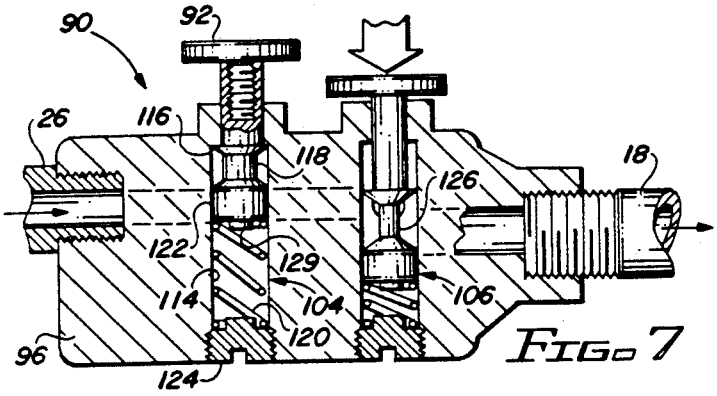
FIG. 7 is a cross sectional view taken along lines 7—7, as shown in FIG. 6.
Figure 9:
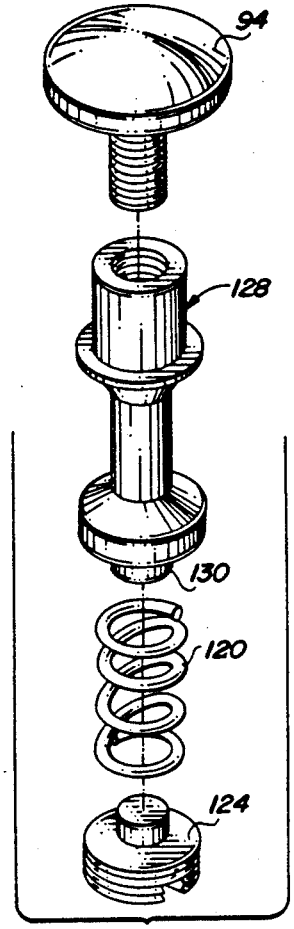
FIG. 9 is an exploded view of a valve assembly.
Figure 8:
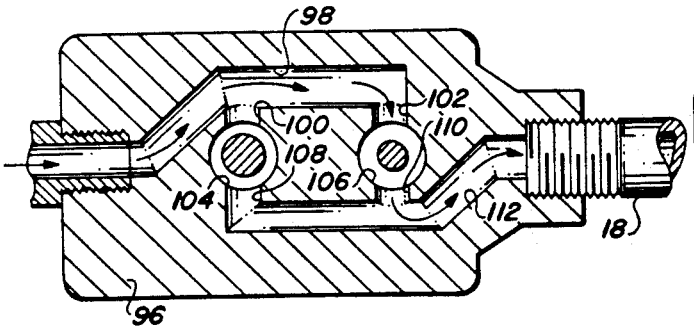
FIG. 8 is a cross sectional view taken along lines 8—8, as shown in FIG. 6.

Referring to FIG. 6, there is illustrated a variant 90 of the present invention, which variant provides a pair of push buttons 92, 94 to select a low or high air flow rate through nozzle 18. Variant 90 includes a body 96 in fluid communication with a source of air under pressure through a hose connected to a coupling 14 attached to a hollow threaded stud 26. The hollow threaded stud is in fluid communication with a passageway 98 having a pair of legs 100, 102 extending to valves 104, 106. Legs 108, 110, extending from valves 104, 106, respectively, interconnect with passageway 112, which passageway is in fluid communication with nozzle 18. Valve 104 includes a cylinder 114 for translatably supporting a piston 116. Piston 116 includes an annular necked down section 118. A coil spring 120, positionally retained by land 129, biases piston 116 and attached push button 92 upwardly. At the uppermost position, as illustrated in FIG. 7, skirt 122 of the piston extends across the outlet associated with leg 100 to prevent air flow into the valve. Upon depressing push button 92, annular necked down section 118 is brought into communication with leg 100 and leg 108. Because of the reduced diameter of the annular necked down section, air will flow therepast from leg 100 to leg 108. The rate of air flow is primarily a function of the diameter of the annular necked down section in combination with the pressure at the source of air pressure and the restriction imposed by nozzle 18. Upon release of push button 92, coil spring 120 will bias piston 116 upwardly to prevent further air flow. A threaded cap 124 is threadedly engaged with the lower end of cylinder 114 to provide support for coil spring 120.

Valve 106 is duplicative of valve 104 except that annular necked down section 126 has a smaller diameter. Accordingly, the necked down section of valve 106 will provide a lesser degree of resistance to air flow between leg 102 and leg 110 than the resistance provided by annular necked down section 118 of valve 104.

In operation, variant 90 is readily hand held. Upon depressing of either of push buttons 92 or 94, the maximum flow rate through nozzle 18, commensurate with the source of air pressure, the configuration of the nozzle and the air flow restriction provided by the respective annular necked down section, will occur. It may be noted that no more skill to operate variant 90 is required than the skill of pushing down one of push buttons 92, 94.

Figure 10:
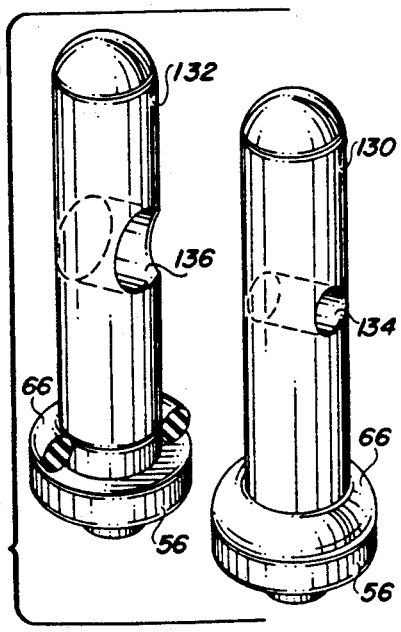
FIG. 10 illustrates variants of the valves usable in conjunction with the embodiments illustrated in FIGS. 1 and 6.

Referring to FIG. 10, there are illustrated variant pistons 130, 132 for use in place of pistons 52, 70, respectively, in air gun 10. It is to be noted that the concept embodied by the structure illustrated in FIG. 10 could also be substituted for the pistons described above with respect to variant 90.

Herein, variant pistons 130, 132 include passages 134, 136, respectively, extending therethrough. Passageway 134, commensurate with the low flow rate function of variant piston 130, is of substantially lesser cross sectional area than that of passage 136. Accordingly, variant piston 130 will limit the flow rate through its associated valve to a greater extent than the restriction provided by passage 136 in variant piston 132.

While the regulator illustrated in each of FIGS. 1 and 6 has been described in the context of an air gun, it is to be appreciated that the flow rate to be restricted to one of two or more flow rates could be with regard to gases other than air or to liquids. Moreover, more than two valves could be embodied in air gun 10 or variant 90 to provide the capability for three or more unambiguous air flow rates upon actuation of the respective valve.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirement without departing from those principles.

I claim:

1. A plural stage air gun assembly for discharging through a nozzle air from a source of air under pressure at a selected unambiguous air flow rate, said assembly comprising in combination:

a) at least two valves for independently controlling the flow rate through said assembly, each of said valves including a component and each said component of each of said valves including a translatable piston and means for translating said piston;

b) means for manually actuating any one of said valves;

c) means for directing air from the source of pressure to each of said valves;

d) means for conveying from each of said valves the air to be discharged; and e) means for providing a predetermined level of restriction of the air flow rate flowing through each of said valves upon actuation of a respective one of said valves and wherein the level of restriction is a function of the configuration of said component of the respective one of said valves.

2. The assembly as set forth in claim 1 wherein each of said translating means is manually operable.

3. The assembly as set forth in claim 1 wherein said translating means includes a manually operable lever.

4. The assembly as set forth in claim 1 wherein said translating means includes a manually operable bush button.

5. The assembly as set forth in claim 1 wherein each said valve includes a cylinder, said cylinder being in fluid communication with each of said air directing means and said air conveying means, a translatable piston disposed within said cylinder for controlling air flow through said cylinder between said air directing means and said air conveying means as a function of the translational position of said piston within said cylinder and means for translating said piston.

6. The assembly as set forth in claim 5 wherein said translating means includes manually operable means for urging translation of said piston in a first direction and bias means for urging translation of said piston in a second direction.

7. The assembly as set forth in claim 5 wherein each said piston includes a section of reduced cross sectional area for providing a path through a section of said cylinder for air flow between said air directing means and said air conveying means.

8. The assembly as set forth in claim 7 wherein said section comprises an annular necked down section.

9. The assembly as set forth in claim 7 wherein said section comprises a passageway extending through said piston.

10. The assembly as set forth in claim 7 wherein the cross sectional area of said section of one of said pistons is different from the cross sectional area of said section of another of said pistons.

11. The assembly as set forth in claim 5 wherein each of said valves includes manually operable means for translating said piston.

12. The assembly as set forth in claim 11 wherein each of said manually operable means comprises a lever.

13. The assembly as set forth in claim 11 wherein each of said manually operable means comprises a push button.

14. The assembly as set forth in claim 1 including a nozzle, said nozzle being in fluid communication with said air conveying means from each of said valves.

15. The assembly as set forth in claim 14 wherein each said valve includes a cylinder, said cylinder being in fluid communication with each of said air directing means and said air conveying means, a translatable piston disposed within said cylinder for controlling air flow through said cylinder between said air directing means and said air conveying means as a function of the translational position of said piston within said cylinder and means for translating said piston.

16. The assembly as set forth in claim 14 wherein said valves comprise two valves.

17. The assembly as set forth in claim 16 wherein said translating means includes manually operable translating means.

18. A method for controlling the air flow rate from an air gun, said method comprising the steps of:

a) directing air from a source of air under pressure to the air gun;

b) channeling the air directed to the air gun to each of at least two valves, each of which valves includes a piston;

c) actuating one of the valves, including the step of translating the piston disposed in the valve actuated;

d) restricting the air flow rate through each of the valves to a different degree of restriction upon actuation of a respective one of valves, each piston including a section of reduced cross sectional area and wherein the section of reduced cross sectional area is positioned to restrict air flow through the valve upon exercise of said step of actuating and to effect said restricting step;

e) conveying air from each of the valves; and f) discharging the air flowing from the actuated one of the valves through a nozzle.

19. The method as set forth in claim 18 including the step of manually actuating one of the valves.

20. A plural stage fluid valve assembly for discharging fluid through an outlet from a source of fluid under pressure at a selected unambiguous fluid flow rate, said assembly comprising in combination:

a) at least two valves for independently controlling the flow rate through said assembly, each of said valves including a component and each said component of each of said valves including a translatable piston and means for translating said piston;

b) means for manually actuating any one of said valves;

c) means for directing fluid from the source of fluid under pressure to each of said valves;

d) means for conveying from each of said valves the fluid to be discharged; and e) means for providing a predetermined level of restriction of the fluid flow rate flowing through each of said valves upon actuation of a respective one of said valves, the level of restriction attendant said providing means being a function of the configuration of said component of the respective one of said valves.

21. The assembly as set forth in claim 20 wherein said translating means includes a manually operable lever.

22. The assembly as set forth in claim 21 wherein said component comprises a reduced cross sectional area of said piston.

* * * * *